United States Patent [19]

Kortenbrede

[11] Patent Number: 4,881,387

[45] Date of Patent: Nov. 21, 1989

[54] SHACKLE LOCK

[75] Inventor: Ludger Kortenbrede, Telgte, Fed. Rep. of Germany

[73] Assignee: Aug. Winkhaus GmbH & Co. KB, Telgte, Fed. Rep. of Germany

[21] Appl. No.: 345,417

[22] Filed: Apr. 28, 1989

[30] Foreign Application Priority Data

May 6, 1988 [DE] Fed. Rep. of Germany ..... 3815584

[51] Int. Cl.[4] ..... E05B 67/22

[52] U.S. Cl. ..... 70/39; 70/22

[58] Field of Search ..... 70/39, 38 C, 38 B, 38 A, 70/38 R, 26, 25, 52, 61

[56] References Cited

U.S. PATENT DOCUMENTS

| | | | |
|---|---|---|---|
| 1,461,725 | 7/1923 | Cooper | 70/39 |
| 2,374,669 | 5/1945 | Dequick | 70/38 A |
| 3,406,544 | 10/1968 | Schreiber | 70/38 C |
| 3,604,227 | 9/1971 | Athanasa | 70/38 A |

*Primary Examiner*—Robert L. Wolfe

*Attorney, Agent, or Firm*—Brumbaugh, Graves, Donohue & Raymond

[57] ABSTRACT

In the case of a long shackle lock, the end portions of the lock shackle are inserted into housings in a lock body. When this happens, they act on lock control sleeves pushing them out of a lock influencing position into a lock releasing position. The lock bolts move into the engaged position, i.e. in engagement with engagement surfaces on the end portions. The lock cylinder which controls the lock bolts moves into its basic position. The key can be withdrawn. To undo the lock, the lock cylinder is turned into a lock opening condition by the key which will then have been re-inserted. When this happens, the lock bolts are retracted into a disengaged position. The control sleeves then push the end portions at least partially out of the housings. The control sleeves move into the bolt influencing position. Therefore, the lock bolts remain in the disengaged position until the end portions are again inserted into the housings (FIG. 1). To close the lock, all that is needed is to insert the shackle arm end portions into the housings whereupon the key can be withdrawn at once without having been rotated first. The key can only be withdrawn after the end portions have been inserted into the housings until they reach the closed position and have been interlocked.

18 Claims, 4 Drawing Sheets

SHACKLE LOCK

BACKGROUND OF THE INVENTION

The invention relates to a shackle lock, especially with a long shackle, comprising a lock body and a locking shackle, the end portions of the shackle arms being adapted to fit into respective shackle arm housings until a locked position is reached, and being completely separable from the lock body by withdrawal of the arm end portions from the housings, at least one lock bolt being furthermore guided for movement in the lock body and being pretensioned by biassing means in the direction of an engaged position, so that after the arm end portions have been pushed into their locked position inside the arm housings, they move into the engaged position, engaging thereby into a bolt engagement surface of at least one arm end portion, so preventing withdrawal of this arm end portion from the associated arm housing, there being furthermore provided inside the lock body a key-operated bolt withdrawal mechanism which is connected by a gearing to the lock bolt and which can by means of the key be moved against the action of the biassing means from a basic state corresponding to the engaged portion of the lock bolt and in which the key can be inserted and withdrawn, into a lock-opening state which necessarily produces a disengaged position of the lock bolt.

STATEMENT OF THE PRIOR ART

Such a long shackle lock is known from DE-OS 32 28 613.

In the case of the prior art long shackle lock, if the long shackle is to be separated from the lock body, then it is necessary to use the key to hold the lock withdrawal mechanism in the lock opening state and thus maintain the lock bolt in the disengaged position until such time as by withdrawing the shackle arm end portions from the lock body, the bolts become no longer aligned with the bolt engagement surfaces. Since the lock shackle occasionally becomes jammed in the lock body or becomes difficult to move in the housings, it therefore becomes necessary to use one hand to keep the key turned in relation to the lock body and against the action of the pretensioning means while using the other hand to try to pull the lock shackle in relation to the lock body. From the point of view of user-friendliness, this is not a good arrangement.

OBJECT OF THE INVENTION

The invention is based on the problem of so improving a shackle lock of the type mentioned at the outset that removal of the lock shackle from the lock body is facilitated.

SUMMARY OF THE INVENTION

In order to resolve this problem, it is according to the invention proposed that there is in the shackle arm housing a bolt control member, which, subject to spring pressure, bears on the arm end portion, so that when the lock bolt is moved out of the engaged position and into the disengaged position, it causes a displacement of the arm end portion of of the locked position and into the direction of separation from the lock body and thereby out of a bolt release position into a bolt influencing position in which it prevents the return of the lock bolt to its bolt engaged position.

Over and above the advantage of simplified operation when separating the lock shackle from the lock body, the solution according to the invention is also advantageous from the following point of view: where the solution known from DE-OS 32 28 613 is concerned, it is indeed possible to bring about a connection of lock body and lock shackle including the actual inhibiting process easily in that the two ends of the lock shackle arms are inserted into the arm housings. The lock bolts which are maintained in the engaged position by the pretensioning means are then forced back by the cam action between lock bolt and shackle arm end portions, once these latter have entered the housings in the position of closure and they can therefore snap again into position in the engagement surface of the end portions. However, as stated, this presupposes that the arm end portions are able to push the lock bolts back into the arm housings by cam action when the arm end portions are inserted. This prerequisite can however only be met with a relatively primitive and, from the point of view of safety, unfavourable engagement configuration between the lock bolts and the shackle arm end portions. On the other hand, where the solution according to the invention is concerned, by reason of the existence of the bolt control member, the connection between lock shackle and lock body including the inhibiting action, becomes entirely independent of any cam action between the arm end portion of the locking shackle and the lock bolt. The form of engagement between the lock bolt and the arm end portion of the lock shackle can therefore be constructed at will and all with a view to maximum safety.

Another shackle lock has become known by reason of having enjoyed public prior use. In the case of this shackle lock, there are provided in the lock body spring-loaded ball catches which, upon insertion of the end portions of the lock shackle into the housings, engage cup-shaped sockets in the end portions so temporarily securing the lock shackle on the lock body although it is still possible to withdraw the lock shackle by hand. By the key actuation of a locking mechanism, then, retaining bolts can be brought into position behind the ball catches so that the latter can no longer move backwards if a withdrawal force of predetermined magnitude is exerted on the lock bolt. Therefore, the lock is only finally locked once the lock mechanism has been actuated by the key. This solution, which is foreign to the object of the patent as stated at the outset is therefore disadvantageous in comparison with the solution according to the patent in that for purposes of locking, it is not sufficient simply to insert the end portions of the lock shackle arms into the arm housings. In addition, the lock mechanism must be actuated by a key in order to establish the locked state.

According to a preferred embodiment of the invention, the lock bolt is so positively connected by a gearing to the bolt withdrawal mechanism that this latter can only return to its basic state when the lock bolt returns to the bolt engaged position. As a result of this additional measure, it is ensured that the key can be withdrawn only when the lock shackle and the lock body have been fitted together in the closed position and the lock shackle is in the engaged position. Thus, there is no question of the key being withdrawn without the lock body and the lock shackle being properly fitted together and interlocked. This is a substantial advantage over the prior art solutions according to the above-mentioned DE-OS and according to the above-mentioned prior public use, in both of which the key can indeed only be withdrawn when the lock bolt is in the engaged position, although there is no guarantee that the lock bolt is then also actually engaging the engagement surface of the relevant shackle arm end portion.

As already mentioned above, the solution according to the invention basically provides the possibility of any desired configuration of engagement between the lock bolt and the arm end portion of the lock shackle. On this basis, it is suggested as a further development of the invention that the lock bolt intersects with and is at a distance from the axis of the associated arm end portion and engages into a bolt engagement surface constructed as a tangential groove in the arm end portion and parallel with the longitudinal direction of the lock bolt. By this configuration of engagement, rotation of the arm end portion is substantially prevented by the exertion of a twisting moment on the lock shackle. Furthermore, there is a form of engagement between lock bolt and arm end portion which makes is impossible for any retroaction on the bolt withdrawal mechanism if there is an attempt made to twist or withdraw the relevant lock shackle arm.

The positive geared connection between the lock bolt and the bolt withdrawal mechanism can be brought about with the advantage of a particularly simple construction of gearing in that the bolt withdrawal mechanism consists of a lock cylinder and, adapted to rotate in a lock cylinder housing, a lock cylinder core which in the basic state, when the key is withdrawn, is prevented from rotating by pin tumblers or the like, and when the key is inserted, becomes rotatable by the disengagement of the pin tumblers, and in that there is mounted on the lock cylinder core a toothed pinion or the like connected by a rack or the like to the lock bolt. Any desired toothed pinion and rack types are feasible. Particularly simple and economically costed are racks the teeth of which are formed by a succession of perforations in a strip of sheet metal, combined with appropriate types of pinion.

The spring biassing of the bolt control member can easily be achieved in that the bolt control member is pretensioned in the direction of the bolt influencing position by a coil thrust spring biased on an end of the housing.

Despite the fact that the lock body is housing the control member, in order to keep its overall height to a minimum, it is proposed that the bolt control member consists of a control sleeve into which the shackle end portion plunges when it is inserted into the housing. Furthermore, the overall height can be kept to a minimum if the coil thrust spring encloses a portion of the length of the bolt control member.

Influencing of the bolt by the control member can easily be achieved in that in the bolt influencing position, the control member occludes the mouth of one of the bolt guide passages for guiding the lock bolt into the housing. In order to establish the control member in the bolt influencing position, an abutment shoulder may be provided in the recess. This means that the control member has to be introduced from the side which is remote from the insertion aperture into the recess. As explained hereinafter in connection with the construction of the lock body, such a possibility can easily be exploited.

A particularly space-saving accommodation of two lock bolts each of which co-operates with one shackle arm end portion can also, if the travel of the lock bolt is considerable with a view to ensuring a very secure engagement between lock bolts and arm end portions, in that as a bolt withdrawal mechanism, a lock cylinder is disposed in the lock body between the two shank housings with an axis approximately parallel with the shackle arm end portions and in that two lock bolts each of which is associated with one of the two arm end portions are guided in a guide plane which is virtually at right-angles to the arm end portions, substantially parallel with the shackle plane in guides which are offset in respect of each other at right-angles to the shackle plane and in that the engagement surfaces on the arm end portions are disposed on opposite sides of the shackle plane and in that the racks engage the pinion at mutually diametrically opposed places on the pinion.

The restoring means can likewise be space-savingly and structurally easily accommodated in that the racks are mounted in axially offset manner on the lock bolts and in that the restoring means comprise at least one coil thrust spring which is biased at one end on ends of the lock bolt which are towards the lock cylinder and at the other end on abutments rigid with the lock casing and close the lock cylinder. At this juncture, it should also be remarked that by virtue of the positive connection of the bolt withdrawal mechanism, in other words for example the positive connection of the lock cylinder core to the lock bolts, it is possible to manage with one single system of restoring means and under certain circumstances perhaps even with a single coil thrust spring at the location just mentioned, so that in other words separate restoring means are not needed for the lock cylinder and for the lock bolts.

With a view to simple manufacture of the lock body, it is furthermore suggested that the lock body consists of two members which abut in a median plane through the lock body parallel with the arm end portions and at right-angles to the shackle plane, each of the said members comprising a shackle arm end housing, a lock bolt guide and in each case half of a housing for the bolt withdrawal mechanism, for example a lock cylinder. In the case of such a development, the members are easily accessible for incorporation of the housings for the bolt withdrawal mechanism. The two partial members can easily be connected to each other.

It is possible to manage with a single form of partial member if the members are of identical construction and are fitted together in positions which are offset to each other by 180° in respect of the lock cylinder axis. If, then, the lock bolt guides in the members are disposed outside of the shackle plane, then by virtue of the 180° offset of these members, there is necessarily an offset at right-angles to the shackle plane which is required in order to ensure diametrically offset engagement of the toothed racks into the toothed pinion.

A simple way of securing the members in their position of reciprocal connection resides in housing them in a member-enclosing housing. This provides the further advantage that the lock bolt guides can be constructed as open guide grovves in the said members which can easily be produced by casting or injection moulding processes without any metal-cutting machining operation.

A simple manufacture and assembly of the member-enclosing housing can be achieved if the said housing is formed by a basically U-shaped housing, the web wall of which is disposed at right-angles to the arm end portions on one side face of the members and into which the arm housings open out, and of which the arm walls bear on side faces of the members which are parallel with the shackle plane and if this basic housing is occluded by a bottom plate. The bottom can thereby be welded to the side walls of the U-shaped housing. It is possible to dispense with any closure across the ends of the U-shaped housing because of course in the unlocked state, the arm end portions engage through holes in the web wall and into the housings so that the partial members in the housing are protected by the arm end portions against being pushed out of place.

The members can easily be produced from pressure die-case zinc material in which case then the safety function can be taken over the the member-enclosing housing which can easily be constructed from steel plate. In consideration of the above-indicated form of engagement between lock bolt and arm end portions, there is virtually no loading on the members in the event of withdrawal or rotation attempts, particularly if the lock bolts bear on the arm walls of the member-enclosing housing in the region of the engagement point. For this reason, the safety function is in no way restricted by the fact that the members are produced from a relatively soft material such as pressure die-cast zinc.

In order to optimise the visual impression of the lock body and to permit manufacture of the partial members or body parts without regard to aesthetic requirements and solely with an eye to structural and weight-saving requirements, it is suggested that the lock body be accommodated in a covering housing of synthetic plastics material.

In order easily to produce and fit the covering housing, a first possibility which is suggested is that the covering housing be divided approximately along the shackle plane. In this case, the parts of the covering housing can be glued or welded to each other in the plane of division.

In order to be able to produce the parts of the covering housing with a single mould while at the same time ensuring that also the parts of the covering housing are secured by the end portions of the shackle arms while the lock is unlocked, it is suggested that the parts of the covering housing be identically shaped and offset to each other by 180° in respect of a median axis through the lock parallel with the arm end portions, both housing parts each having a ring through which an arm end portion can pass, the said rings being offset by their wall thickness in respect of each other on each housing part in the longitudinal direction of the shackle arm end portions.

Another possibility of constructing the covering housing is for the covering housing to be divided along a median plane at right angles to the shackle plane and parallel with the arm end portions, the halves of the housing being connected to each other by an overlapping joint.

BRIEF DESCRIPTION OF THE DRAWINGS

An example of embodiment of the invention is explained in greater detail hereinafter with reference to the accompanying drawings, in which.

DETAILED DESCRIPTION OF THE PREFERRED EMBODIMENTS

Figure 1:
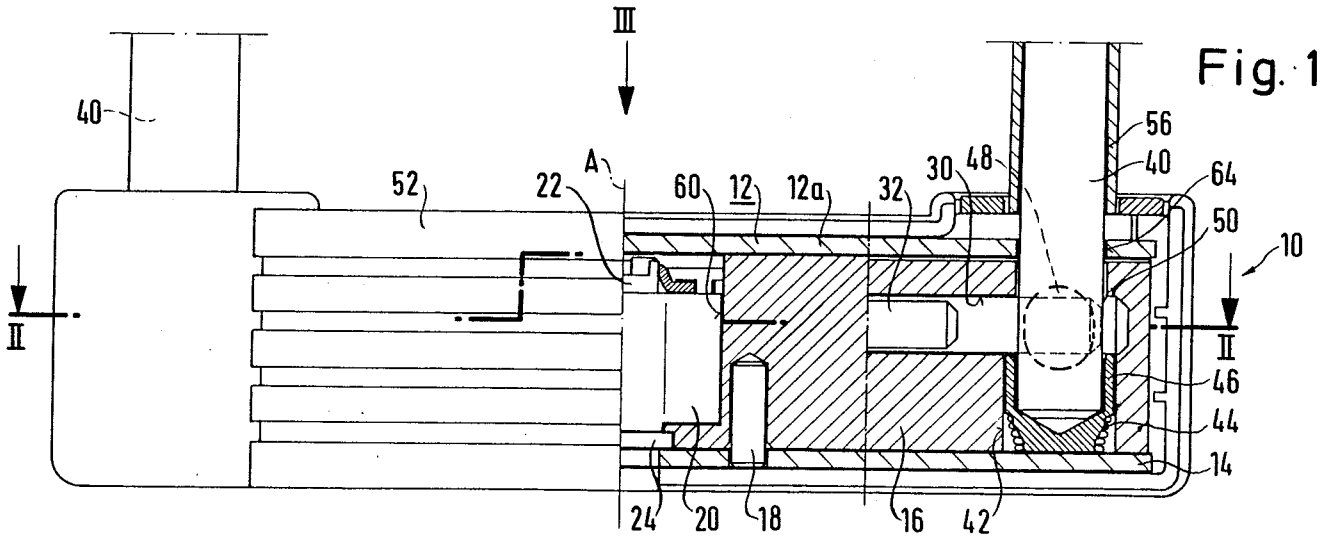
FIG. 1 shows a long shackle lock according to the invention, partly in section in the shackle plane.

In the drawings, the lock body is generally designated 10. It consists substantially of a U-shaped steel casing 12, closed on the underside by a welded-on bottom plate 14. Inside the casing 12, there are two identically-shaped members 16 offset by 180°, the said members 16 being exactly the same as each other and being held in alignment with each other axially in the region of the median plane A through the lock by a pin and a pin housing bore. Fitted together in this aligned position, the members 16 are secured in their position in relation to the U-shaped steel casing 12 by pins 18 inserted in the bottom plate 14. At the mutually opposite end faces, the members 16 form a substantially cylindrical bore 60 to accommodate a lock cylinder 20 with a cylinder core 22. The side on which the key hole is situated is masked by a plate 24.

Figure 2:
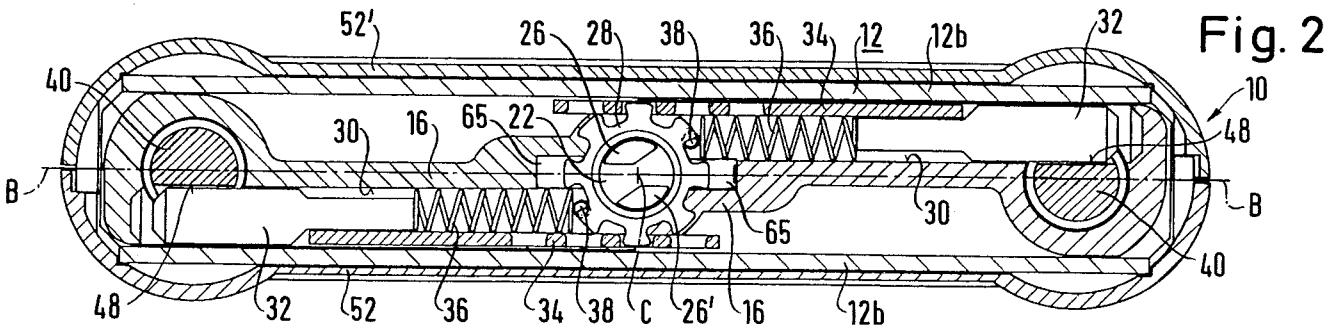
FIG. 2 shows a cross-section taken on the line II—II in FIG. 1.

At the end opposite the key hole, the cylinder core 22 has two axially projecting dogs 26, 26' for the form-locking accommodation of a sprocket 28. Guided for displacement in a passage 30 in the body part 16 is a lock bolt 32 fixed to which there is a rack 34 (fixed for example by welding). The lock bolts 32 are capable of a twofold action for reciprocal interlocking. FIG. 2 clearly shows the engagement of the sprocket 28 into the oppositely disposed racks 34. The lock bolt 32 is biased by a spring 36 in the direction of the position of engagement, the spring being biased on a pin 38 mounted in the passage 30.

To accommodate the lock shackle 40, there is in the body part 16 a housing in the form of a stepped bore 42 in which, in the region of larger diameter there is a displaceably guided control sleeve 46 pretensioned by a spring 44. The spring 44 is preferably of conical construction, so that the likewise conically formed end portion of the control sleeve 46 can plunge into the spring in the closed position. The space which is thus gained means that the end portion 40 of the lock shackle arms can be pushed more deeply into the body part 16. The arm end portion 40 of the lock shackle comprises a concave engagement surfaces 48 engaged by the lock bolt 32 in the engaged position. When the arm end portion 40 is pushed into the lock body 10, the end portions 40 of the lock shackle engage the pot-shaped control sleeve 46, displacing it in the direction of the bottom plate 14. When the shackle housing 48 is aligned with the bolt guide passage 30, the lock bolt 32, biased by the coil thrust spring 36 moves into the bolt engagement surface 48 and locks the arm end portions 40 of the bolt shackle in this locked position. Consequently, interlocking is automatic with no need for the lock cylinder 20 to be actuated by the turning of a key.

If the lock has to be opened and if the arm end portion 40 of the lock shackle has to be removed, then the cylinder core 22 must be turned in an anticlockwise direction according to FIG. 2, by means of a suitable key, i.e. in a clockwise direction when viewed from below. When this happens, the lock bolt 32 is by the form-locking connection between the sprocket 28 and the rack 34 pulled sufficiently far in the direction of the lock cylinder 20 that the lock bolt 32 becomes disengaged from the surface 48 and assumes a disengaged position. The arm end portion 40 of the lock shackle is now pushed by th pretensioned control sleeve 46 sufficiently out of the body part 16 until it comes to bear on the shoulder 50 inside the stepped bore 42. The end portion 40 of the lock shackle can now be removed. By virtue of the bolt influencing position of the control sleeve 46 which is thus attained, the bolt guide passage 30 is at the same time also partially blocked (see FIGS. 8 and 9) and the free end of the pretensioned lock bolt 32 is biased on the outer peripheral surface of the control sleeve 46. As a result, it is ensured that during subsequent pushing of the arm end portion 40 of the lock shackle into position, the lock bolt 32 thanks to its initial tension can automatically move into the engagement surface 48 when the control sleeve 46 has again cleared the bolt guide passage 30, i.e. has moved into its bolt releasing position. The key which belongs to the lock cylinder 20 can basically only be withdrawn when the shackle arm end portion 40 is in the closed position, since only in this closed position can the lock bolt 32 assume the engaged position shown in FIG. 2 so that only then can the lock cylinder core assume its basic stage as shown in FIG. 2, which is the only condition in which the key can be inserted and withdrawn.

Figure 5:
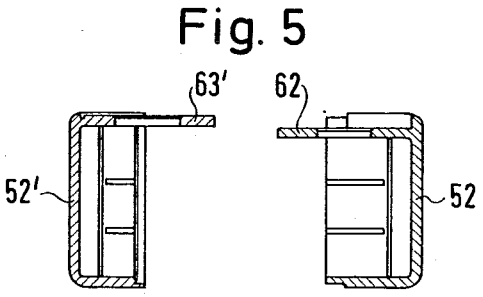
FIG. 5 shows a cross-section taken on the line V—V in FIG. 3.
Figure 4:
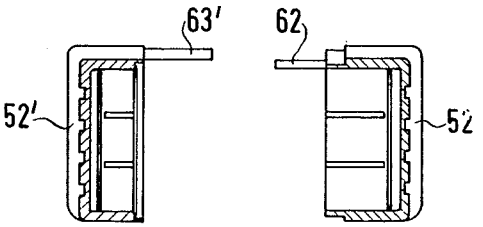
FIG. 4 shows a cross-section taken on the line IV—IV in FIG. 3.
Figure 3:
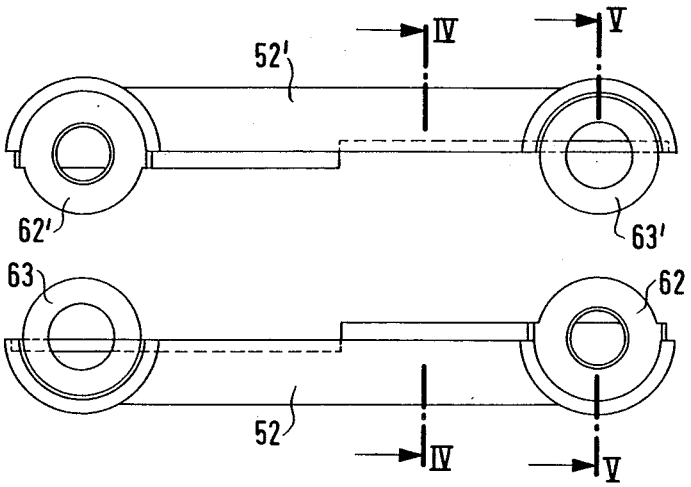
FIG. 3 shows the parts of a covering housing in plan view according to the arrow III in FIG. 1.

The lock body 10 is enclosed on all sides by a covering housing 52, 52' (FIG. 3) which is divided in the longitudinal plane of the lock body 10 and of which the abutting marginal edges partially overlap (see FIG.3). The covering housing 52, 52' consists of two housing halves 52, 52' which according to FIGS. 3, 4 and 5 are used in a mirrored opposite disposition. The two halves 52, 52' are welded to each other along the encircling joints.

As FIGS. 3 to 5 show, the housing halves have at both ends rings 62, 63, 62', 63' offset in respect to each other in their height and which, when the housing halves 52, 52' are fitted together, come into a position over one another so allowing passage to the arm end portions 40.

Figure 6:
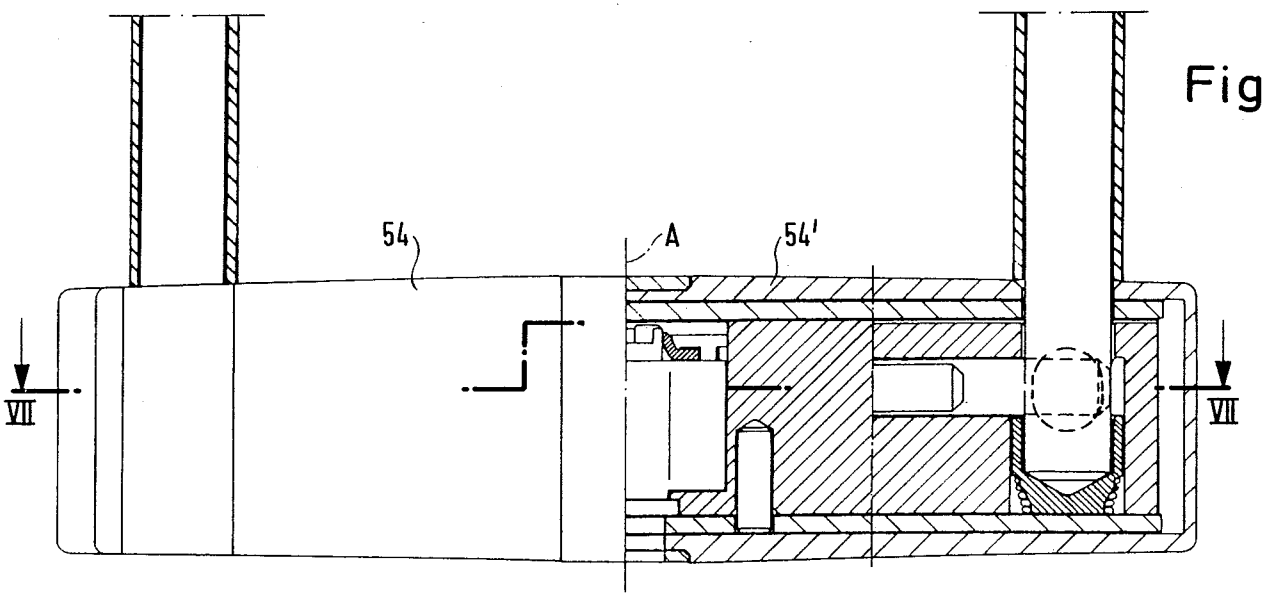
FIG. 6 is a view corresponding to that in FIG. 1 but of a further embodiment which has a modified covering housing.
Figure 7:
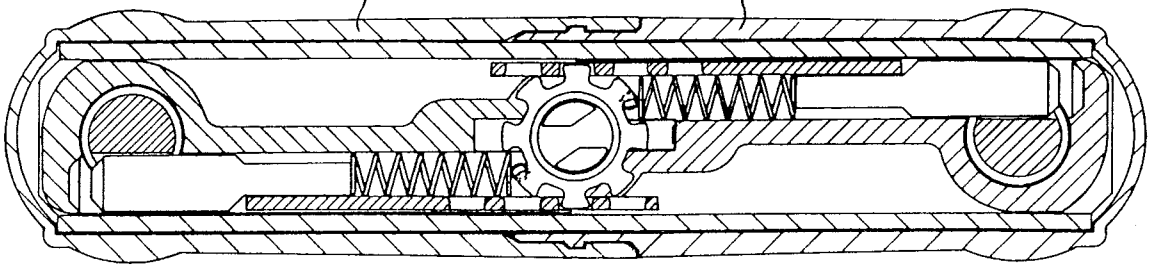
FIG. 7 shows a cross-section taken on the line VII—VII in FIG. 6.

An alternative embodiment of covering housing 54, 54' is shown in FIGS. 6 to 7. The plane of connection of the two housing halves in this case extends transversely to the longitudinal plane of the lock body 10. Integrally moulded projecting catches and recesses make it possible for the housing halves to be connected to each other and then welded along the abutting joint.

It must be added that there are in the web wall 12*a* of the U-shaped steel housing 12 bores 64 which allow passage of the arm end portions 40, so that the body parts or members 16 can, when the arm end portions 40 are inserted, be form-lockingly secured in the U-shaped steel housing 12 in the same way as are the covering housing halves 52, 52'. Furthermore, it must also be pointed out that the bolt guide passages 30 are open towards the arm or side walls 12*b* of the U-shaped steel housing 12, so that the lock bolts 32 are guided to bear on these walls 12*b*. The shackle plane is designated B in FIG. 2. The engagement surfaces 48 of the two shackle end portions 40 rest on different sides of the end portions 40 and thus of the shackle plane B, so that the racks 34 are at diametrically opposed locations engaged with the sprocket 28 or a pinion which lies in the direction of a median lock axis C, also the lock cylinder axis coinciding with the median axis C of the lock. Recesses 65 are provided in the body parts 16 to accommodate the profiled bag usual with lock cylinders.

Figure 8:
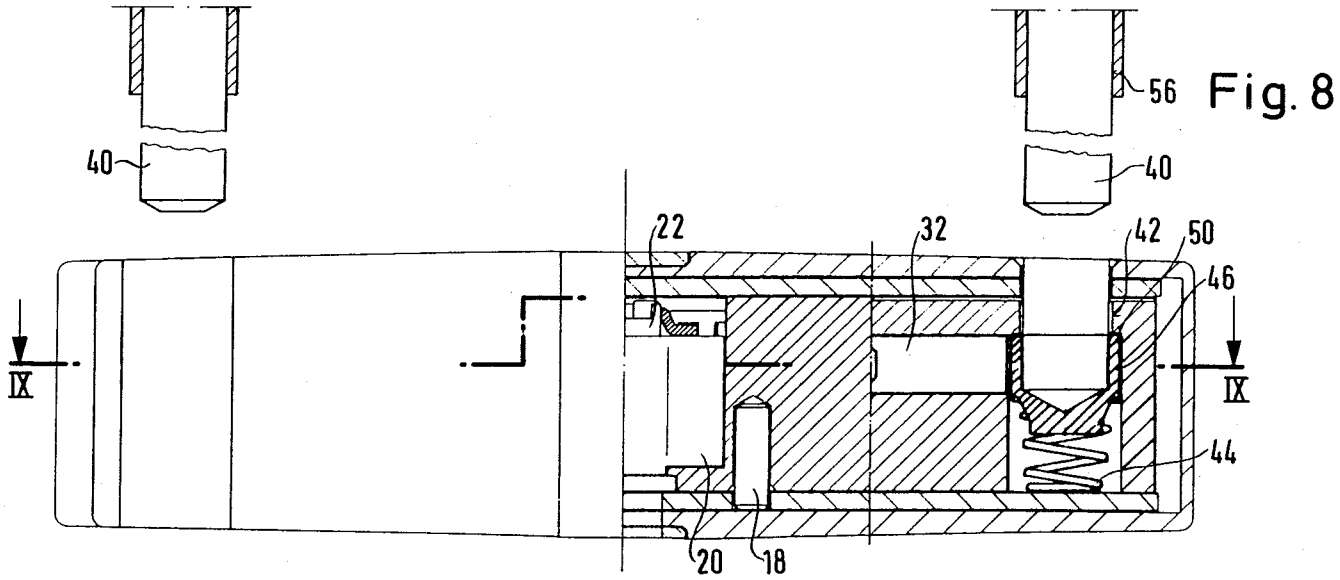
FIG. 8 shows a long shackle lock corresponding to FIGS. 1 and 6 with the lock shackle separated from the lock body and FIG. 9 shows a cross-section taken on the line IX—IX in FIG. 8.
Figure 9:
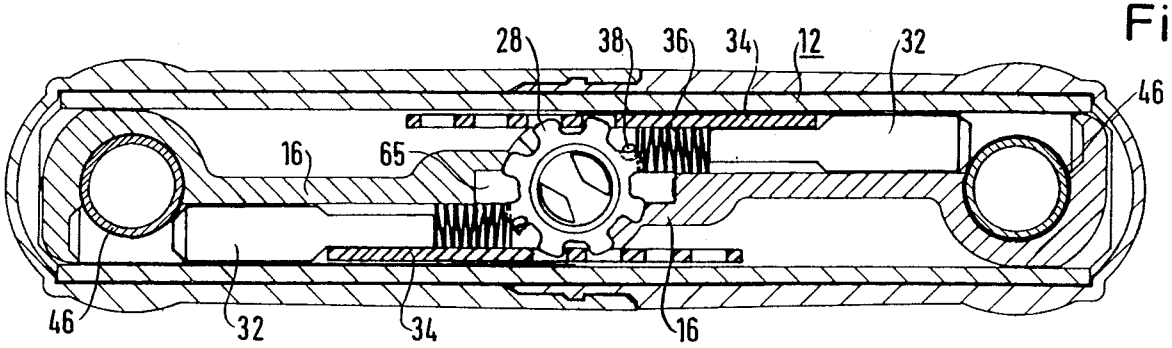

In FIGS. 8 and 9, the shackle arm end portions 40 are withdrawn from the housings 42 so that the control sleeve 46 assumes its bolt influencing position in which it bears on the shoulder 50. It must be pointed out that when the lock bolt 32 is withdrawn into the disengaged position according to FIG. 1, the control sleeve 46 under the action of the coil thrust spring 44 has moved up and has pushed the end portions 40 partially but positively out of the housings 42.

With reference to FIGS. 1, 2, 8 and 9, the mode of operation of the shackle lock can be summed up as follows: in FIGS. 1 and 2, the lock is locked. The lock bolts 32 are in the locked position, engaging the engagement surfaces 48 on the arm end portions 40. The lock cylinder 20 is in its basic condition. The key is withdrawn and can be inserted. In order to open or undo the lock, the key is inserted and, starting from the position shown in FIG. 2, the lock cylinder core 22 is rotated in an anticlockwise direction, i.e. if viewed from below, it is rotated in a clockwise direction, the lock bolts 32 being pulled back in the direction of the lock cylinder 20, in fact back through the position shown in FIG. 9. Then the coil thrust springs 44 are relieved and via the control sleeve 46 they push the end portions 40 in FIG. 1 upwardly in the direction of the position shown in FIG. 8. When this happens, the control sleeves 46 immediately occlude the bolt guide passages 30 so that the key can be released again immediately whereupon the lock bolts 32 will remain in the position shown in FIG. 9 since they abut the relevant control sleeve 46. Since the lock bolts 32 remain in the disengaged position shown in FIG. 9, also the lock cylinder core cannot return to its basic condition shown in FIGS. 1 and 2 but remains in the position shown in FIG. 9. Withdrawal of the key is not possible, therefore, so long as the end portions 40 of the shackle arms, as shown in FIG. 8, are withdrawn from the arm housings 42. In order to lock the shackle lock, all that is needed is to push the arm end portions 40 back into the arm housings 42. They then push the control sleeves 46 back into the position shown in FIGS. 1 and 2. When the end portions 40 have reached the position of closure shown in FIG. 1, the lock bolts 32 can return from the disengaged position in FIGS. 8 and 9 to the engaged position in FIGS. 1 and 2 and re-engaged the engagement surfaces 48. Only then is the lock cylinder core 22 in the basic condition shown in FIGS. 1 and 2 and only then can the key be withdrawn. If the key can be withdrawn, then this is an assurance that the lock shackle has been fitted together with the lock body 10 and is locked by the lock bolts 32. If an attempt is made to rotate the end portions 40 of the shackle arms, the lock bolts 32 are pressed against the walls 12*b* of the steel housing but there is no reaction on the lock cylinder 20. For the rest, rotation of the end portions 40 is prevented by the tangential engagement of the lock bolts 32 into the engagement surfaces 48 since of course the walls 12*b* cannot move aside since they have been welded to each other over the bottom plate 14.

FIGS. 6 and 7 only differ from the embodiment according to FIGS. 1 to 5 by virtue of the different configuration of the covering housing 54, 54'. The halves of the covering housing here abut in the median plane A of the lock and overlap as shown in FIG. 7. They are welded to each other in the region of this overlap.

FIGS. 8 and 9 show the same form of covering housing as in FIGS. 6 and 7. However, since with regard to the arrangement, there is identity with the embodiment shown in FIGS. 1 to 5, reference is made to FIGS. 8 and 9 with regard to the lock opening condition.

What is claimed is:

1. A shackle lock, especially with a long shackle, comprising a lock body (10) and a locking shackle, the end portions (4) of the shackle arms being adapted to fit into respective shackle arm housings (42) until a locked position is reached (FIG. 1), and being completely seaparable from the lock body (10) by withdrawal of the arm end portions (40) from the housings (42) (FIG. 8), at least one lock bolt (32) being furthermore guided for movement in the lock body (10) and being pretensioned by biassing means (36) in the direction of an engaged position (FIGS. 1 and 2), so that after the arm end portions (40) have been pushed into their locked position inside the arm housings (42), they move into the engaged position (FIGS. 1 and 2), engaging thereby into a bolt engagement surface (48) of at least one arm end portion (40), so preventing withdrawal of this arm end portion (40) from the associated arm housing (42), there being furthermore provided inside the lock body (10) a key-operated bolt withdrawal mechanism (20) which is connected by a gearing (28, 34) to the lock bolt (32) and which can by means of the key be moved against the action of the biassing means (36) from a basic state (FIGS. 1 and 2) corresponding to the engaged position of the lock bolt (32) and in which the key can be inserted and withdrawn, into a lock-opening state (FIG. 9) which necessarily produces a disengaged position of the lock bolt (32), characterised in that there is in the shackle arm housing (42) a bolt control member (46), which, subject to spring pressure (44), bears on the arm end portion (40), so that when the lock bolt (32) is moved out of the engaged position (FIGS. 1 and 2) and into the disengaged position (FIGS. 8 and 9), it causes a displacement of the arm end portion (40) out of the locked position and into the direction of separation from the lock body (10) (FIGS. 8 and 9) and thereby out of a bolt release position (FIGS. 1 and 2) into a bolt influencing position (FIGS. 8 and 9) in which it prevents the return of the lock bolt (32) to its bolt engaged position (FIGS. 1 and 2) (FIGS. 8 and 9).

2. A shackle lock, especially with a long shackle, comprising a lock body (10) and a locking shackle, the end portions (4) of the shackle arms being adapted to fit into respective shackle arm housings (42) until a locked position is reached (FIG. 1), and being completely separable from the lock body (10) by withdrawal of the arm end portions (40) from the housings (42) (FIG. 8), at least one lock bolt (32) being furthermore guided for movement in the lock body (10) and being pretensioned by biassing means (36) in the direction of an engaged position (FIGS. 1 and 2), so that after the arm end portions (40) have been pushed into their locked position inside the arm housings (42), they move into the engaged position (FIGS. 1 and 2), engaging thereby into a bolt engagement surface (48) of at least one arm end portion (40), so preventing withdrawal of this arm end portion (40) from the associated arm housing (42), there being furthermore provided inside the lock body (10) a key-operated bolt withdrawal mechanism (20) which is connected by a gearing (28, 34) to the lock bolt (32) and which can by means of the key be moved against the action of the biassing means (36) from a basic state (FIGS. 1 and 2) corresponding to the engaged position of the lock bolt (32) and in which the key can be inserted and withdrawn, into a lock-opening state (FIG. 9) which necessarily produces a disengaged position of the lock bolt (32), characterised in that the lock bolt (32) is so positively connected by a gearing (28, 34) to the bolt withdrawal mechanism (20) that this latter can only return to its basic state (FIGS. 1 and 2) when the lock bolt (32) returns to the bolt engaged position (FIGS. 1 and 2).

3. A shackle lock according to claim 1, characterised in that the lock bolt (32) intersects with and is at a distance from the axis of the associated arm end portion (40) and engages into a bolt engagement surface (48) constructed as a tangential groove in the arm end portion (40) and parallel with the longitudinal direction of the lock bolt (32).

4. A shackle lock, especially with a long shackle, comprising a lock body (10) and a locking shackle, the end portions (4) of the shackle arms being adapted to fit into respective shackle arm housings (42) until a locked position is reached (FIG. 1), and being completely separable from the lock body (10) by withdrawal of the arm end portions (40) from the housings (42) (FIG. 8), at least one lock bolt (32) being furthermore guided for movement in the lock body (10) and being pretensioned by biassing means (36) in the direction of an engaged position (FIGS. 1 and 2), so that after the arm end portions (40) have been pushed into their locked position inside the arm housings (42), they move into the engaged position (FIGS. 1 and 2), engaging thereby into a bolt engagement surface (48) of at least one arm end portion (40), so preventing withdrawal of this arm end portion (40) from the associated arm housing (42), there being furthermore provided inside the lock body (10) a key-operated bolt withdrawal mechanism (20) which is connected by a gearing (28, 34) to the lock bolt (32) and which can by means of the key be moved against the action of the biassing means (36) from a basic state (FIGS. 1 and 2) corresponding to the engaged position of the lock bolt (32) and in which the key can be inserted and withdrawn, into a lock-opening state (FIG. 9) which necessarily produces a disengaged position of the lock bolt (32), characterised in that the bolt withdrawal mechanism (20) consists of a lock cylinder (20) and, adapted to rotate in a lock cylinder housing, a lock cylinder core (22) which in the basic state (FIGS. 1 and 2), when the key is withdrawn, is prevented from rotating by pin tumblers or the like, and when the key is inserted, becomes rotatable by the disengagement of the pin tumblers, and in that there is mounted on the lock cylinder core (22) a toothed pinion (28) or the like connected by a rack (34) or the like to the lock bolt (32).

5. A shackle lock according to claim 1, characterised in that the bolt control member (46) is pretensioned in the direction of the bolt influencing position (FIG. 8) by a coil thrust spring (44) biased on an end (14) of the housing (42).

6. A shackle lock according to claim 1, characterised in that the bolt control member (46) consists of a control sleeve into which the shackle end portion (40) plunges when its is inserted into the housing (42).

7. A shackle lock according to claim 5, characterised in that the coil thrust spring (44) encloses part of the length of the bolt control member (46).

8. A shackle lock according to claim 1, characterised in that in the bolt influencing position (FIGS. 8 and 9), the control member (46) occludes the mouth of one of the bolt guide passages (40) for guiding the lock bolt (32) into the housing (42).

9. A shackle lock according to claim 1, characterised in that there is in the housing (42) an abutment shoulder (50) which establishes the bolt influencing position (FIGS. 8 and 9) of the bolt control member (46).

10. A shackle lock according to claim 4, characterised in that as a bolt withdrawal mechanism, a lock cylinder (20) is disposed in the lock body (10) between the two shank housings (42) with an axis (A) approximately parallel with the shackle arm end portions (40) and in that two lock bolts (32) each each of which is associated with one of the two arm end portions (40) are guided in a guide plane which is virtually at right-angles to the arm end portions (40), substantially parallel with the shackle plane (B) in guides (30) which are offset in respect of each other at right-angles to the shackle plane (B) and inthat the engagement surfaces (48) on the arm end portions (40) are disposed on opposite sides of the shackle plane (B) and in that the racks (34) engage the pinion (28) at mutually diametrically opposed places on the pinion (28).

11. A shackle lock according to claim 10, characterised in that the racks (34) are mounted in axially offset manner on the lock bolts (32) and in that the restoring means (36) comprise at least one coil thrust spring (36) which is biased at one end on ends of the lock bolt (32) which are towards the lock cylinder (20) and at the other end on abutments (38) rigid with the lock casing and close to the lock cylinder.

12. A shackle lock, especially with a long shackle, comprising a lock body (10) and a locking shackle, the end portions (4) of the shackle arms being adapted to fit into respective shackle arm housings (42) until a locked position is reached (FIG. 1), and being completely separable from the lock body (10) by withdrawal of the arm end portions (40) from the housings (42) (FIG. 8), at least one lock bolt (32) being furthermore guided for movement in the lock body (10) and being pretensioned by biassing means (36) in the direction of an engaged position (FIGS. 1 and 2), so that after the arm end portions (40) have been pushed into their locked position inside the arm housings (42), they move into the engaged position (FIGS. 1 and 2), engaging thereby into a bolt engagement surface (48) of at least one arm end portion (40), so preventing withdrawal of this arm end portion (40) from the associated arm housing (42), there being furthermore provided inside the lock body (10) a key-operated bolt withdrawal mechanism (20) which is connected by a gearing (28, 34) to the lock bolt (32) and which can be means of the key be moved against the action of the biassing means (36) from a basic state (FIGS. 1 and 2) corresponding to the engaged position of the lock bolt (32) and in which the key can be inserted and withdrawn, into a lock-opening state (FIG. 9) which necessarily produces a disengaged position of the lock bolt (32), characterised in that the lock body (10) consists of two members (16) which abut in a median plane (A) through the lock body parallel with the arm end portions (40) and at right-angles to the shackle plane (B), each of the said members (16) comprising a shackle arm end housing (42), a lock bolt guide (30) and in each case half of a housing (60) for the bolt withdrawal mechanism (20), for example a lock cylinder (20).

13. A shackle lock according to claim 12, characterised in that the members (16) are identically shaped and are fitted together in positions which are offset in respect of each other by 180° vis-a-vis the lock cylinder axis (C).

14. A shackle lock according to claim 13, characterised in that the members (16) are housed in a member enclosing housing (12, 14).

15. A shackle lock according to claim 14, characterised in that the member-enclosing housing (12, 14) consists of a U-shaped basic housing (12), of which the web wall (12*a*) is disposed at right-angles to the shackle arm end portions (40) on one side face of the member (16) at which the shackle arm housings (42) terminate, and of which the arm walls (12*b*) bear on side faces of the members (16) which are parallel with the shackle plane (B) and in that this basic housing (12) is occluded by a bottom plate (14).

16. A shackle lock according to claim 14, characterised in that the members (16) consist of die-cast zinc material while the member-enclosing housing (12, 14) consists of steel plate.

17. A shackle lock, especially with a long shackle, comprising a lock body (10) and a locking shackle, the end portions (4) of the shackle arms being adapted to fit into respective shackle arm housings (42) until a locked position is reached (FIG. 1), and being completely separable from the lock body (10) by withdrawal of the arm end portions (40) from the housings (42) (FIG. 8), at least one lock bolt (32) being furthermore guided for movement in the lock body (10) and being pretensioned by biassing means (36) in the direction of an engaged position (FIGS. 1 and 2), so that after the arm end portions (40) have been pushed into their locked position inside the arm housings (42), they move into the engaged position (FIGS. 1 and 2), engaging thereby into a bolt engagement surface (48) of at least one arm end portion (40), so preventing withdrawal of this arm end portion (40) from the associated arm housing (42), there being furthermore provided inside the lock body (10) a key-operated bolt withdrawal mechanism (20) which is connected by a gearing (28, 34) to the lock bolt (32) and which can by means (36) from a basic state (FIGS. 1 and 2) corresponding to the engaged position of the lock bolt (32) and in which the key can be inserted and withdrawn, into a lock-opening state (FIG. 9) which necessarily produces a disengaged position of the lock bolt (32), characterised in that the lock body (10) is accommodated in covering housing (52, 52′) of synthetic plastics material, that the covering housing (52, 52′) is divided approximately along the shackle plane (B), and that the parts (52, 52′) of the covering housing are identically shaped and are offset in respect of each other by 180° in respect of a median axis (A) through the lock parallel with the shackle arm end portions (40), both partial housings (52, 52′) each having a ring (62, 63, 62′, 63′) through which a shackle arm end portion (40) can pass, the rings (62, 63, 62′, 63′) being offset in respect of each other by their wall thickness in the longitudinal direction of the arm end portions (40) and on each housing (52, 52').

18. A shackle lock, especially with a long shackle, comprising a lock body (10) and a locking shackle, the end portions (4) of the shackle arms being adapted to fit into respective shackle arm housings (42) until a locked position is reached (FIG. 1), and being completely separable from the lock body (10) by withdrawal of the arm end portions (40) from the housings (42) (FIG. 8), at least one lock bolt (32) being furthermore guided for movement in the lock body (10) and being pretensioned by biassing means (36) in the direction of an engaged position (FIGS. 1 and 2), so that after the arm end portions (40) have been pushed into their locked position inside the arm housings (42), they move into the engaged position (FIGS. 1 and 2), engaging thereby into a bolt engagement surface (48) of at least one arm end portion (40), so preventing withdrawal of this arm end portion (40) from the associated arm housing (42), there being furthermore provided inside the lock body (10) a key-operated bolt withdrawal mechanism (20) which is connected by a gearing (28, 34) to the lock bolt (32) and which can by means of the key be moved against the action of the biassing means (36) from a basic state (FIGS. 1 and 2) corresponding to the engaged position of the lock bolt (32) and in which the key can be inserted and withdrawn, into a lock-opening state (FIG. 9) which necessarily produces a disengaged position of the lock bolt (32), characterised in that the lock body (10) is accommodated in a covering housing (52, 52') of synthetic plastics materials and that the covering housing (54, 54') is divided in a median plane (A) parallel with the arm end portions (40) and at right-angles to the shackle plane (B), the housing halves (54, 54') being connected to each other by an overlapping joint.

* * * * *

UNITED STATES PATENT AND TRADEMARK OFFICE

CERTIFICATE OF CORRECTION

PATENT NO. : 4,881,387

DATED : November 21, 1989

INVENTOR(S) : Ludger Kortenbrede

It is certified that error appears in the above-identified patent and that said Letters Patent is hereby corrected as shown below:

First page, item 73, first line, "KB" should read --KG--;
Col. 4, line 42, after "housings" insert --which receive the lock bolt guides and the partial housings--;
Col. 4, line 59, "grovves" should read --grooves--;
Col. 6, line 57, "surfaces" should read --surface--;
Col. 7, line 12, "th" should read --the--;
Col. 7, line 33, "stage" should read --state--;
Col. 8, line 54, "re-engaged" should read --re-engage--;
Col. 11, line 1, "its is" should read --it is--;
Col. 11, line 23, "each each" should read --each--;
Col. 11, line 62, "be means" should read --by means--;
Col. 12, line 51, after "means" insert --of the key be moved against the action of the biassing means--.

Signed and Sealed this

Nineteenth Day of February, 1991

*Attest:*

*Attesting Officer*

HARRY F. MANBECK, JR.

*Commissioner of Patents and Trademarks*